United States Patent [19]

Bon

[11] 4,116,782

[45] Sep. 26, 1978

[54] CORROSION PREVENTION SYSTEM

[75] Inventor: Charles K. Bon, Midland, Mich.

[73] Assignee: The Dow Chemical Company, Midland, Mich.

[21] Appl. No.: 774,838

[22] Filed: Mar. 7, 1977

[51] Int. Cl.[2] ..... C23F 13/00

[52] U.S. Cl. ..... 204/147; 204/196

[58] Field of Search ..... 204/147, 196

[56] References Cited

U.S. PATENT DOCUMENTS

| | | | |
|---|---|---|---|
| 2,762,767 | 9/1956 | Mosher et al. | 204/196 |
| 3,477,930 | 11/1969 | Crites | 204/148 |
| 3,525,644 | 8/1974 | Winsel et al. | 204/147 |

OTHER PUBLICATIONS

Underground Corrosion, N.B.S. Circular 579, 1957, pp. 171–176.

*Primary Examiner*—T. M. Tufariello

*Attorney, Agent, or Firm*—Robert W. Selby

[57] ABSTRACT

A method to reduce corrosion of a metal conduit in an aqueous electrolyte conduit system including a nonmetallic conduit system physically attached to the metal conduit comprising impressing an electric potential between an electrode positioned at least partially within the nonmetallic conduit and a ground, the potential being at least about the difference between the electrochemical reaction potentials of reations occurring at the electrode and at the metal conduit.

5 Claims, No Drawings

CORROSION PREVENTION SYSTEM

BACKGROUND OF THE INVENTION

This invention relates to corrosion of metals. More in particular the invention concerns the reduction of corrosion of metal members in systems containing both metallic and nonmetallic components.

Most metals, and especially those containing major amounts of iron, are known to corrode, or rust, when exposed to salt water or other environments capable of conducting an electric current and an electric potential. To retard corrosion of metals, various coatings and anodic or cathodic protection techniques have been developed. Such techniques are exemplified in U.S. Pat. Nos. 3,313,721 and 3,477,930; Morgan, Cathodic Protection 253–265 (1959); and Fontana et al., Corrosion Engineering 205–214 (1967).

In certain equipment an electrically conductive liquid solution, i.e. an electrolyte, flows from electrically charged members through nonmetallic conduits and directly into, and through, metallic conduits attached to the nonmetallic conduit. The electrolyte can flow from the metallic conduit to a suitable receiving container for storage or disposal. Oftentimes stray electric current will flow through the electrolyte and cause the metallic conduit to corrode even though this conduit is not in physical contact with the electrically charged member. Corrosion of the metal portion of this system has previously been reduced by inserting a graphite electrode through the nonmetallic conduit, and into the electrolyte, and connecting this electrode to a ground. A portion of the stray current flowing through the electrolyte was removed, and corrosion of the metallic conduit reduced, by means of such an electrode, but corrosion resulting from stray electric current in such an electrode protected system is still excessive.

An apparatus and method is desired to minimize corrosion of metallic conduits in a system including a source of stray electric current, a nonmetallic conduit and an electrolyte.

SUMMARY OF THE INVENTION

It has been found that corrosion of a metal conduit in an aqueous electrolyte conduit system, which includes a nonmetallic conduit physically attached to the metal conduit, can be reduced. Such reduction in corrosion is achieved by impressing a predetermined electric potential (volts) between an electrode positioned at least partially within the nonmetallic conduit and a ground. The electric potential is at least about the difference between the electrochemical reaction potentials (volts), at the reaction temperature, of the reactions occurring at the electrode and at the metal conduit.

The present invention includes a system to reduce the corrosion of a metal conduit through which an aqueous electrolyte flows. The system comprises, in combination, a source of stray electric current with a conduit, having at least a nonmetallic inner surface, attached thereto. A metal conduit is attached to the nonmetallic conduit. The nonmetallic and metal conduits are adapted to contain the electrolyte as such electrolyte flows to, or from, the stray electric current source, such as an electrolytic cell, from a suitable feedstock container or to predetermined location for disposal. To remove stray electric current flowing through the electrolyte from, for example, the electrolytic cell, an electrode with a higher oxidation potential than the metal conduit is suitably attached to the nonmetallic conduit to be in electrical contact with the electrolyte within such conduit. A means to impress an electric potential between the electrode and an electrical ground is in combination with the electrode. Such potential impressing means is of sufficient size to provide an electric potential at least equal to about the difference between the electrochemical reaction potentials (volts), at the reaction temperature, of the reactions occuring at the electrode and at the metal conduit.

Removing stray electric current from the conduit system in the herein described manner reduces the corrosion rate of the metal conduit whether the exterior surface of the metal is buried in the earth, submerged in water or entirely exposed to air. Thus, the possibility of the metal conduit, such as a pipe, corroding sufficiently from stray electrical current to permit undesired leakage of the electrolyte is minimized.

DESCRIPTION OF THE PREFERRED EMBODIMENTS

In one embodiment, a nonmetallic, electric nonconductive pipe is attached to an electrolytic cell for producing gaseous chlorine from an aqueous solution of sodium chloride. Suitable nonmetallic materials for the pipe are, for example, polytetrafluoroethylene, polyethylene, vinyl esters, acrylonitrile-butadiene-styrene copolymers and the like. The nonmetallic pipe is physically, axially, attached to a metal pipe, generally an iron alloy containing at least 50 weight percent iron, by well-known means to permit the sodium chloride solution, or brine, to flow through both the nonmetallic and iron pipes. The nonmetallic pipe is affixed directly to the electrolytic cell to electrically insulate the cell from metal bodies in close proximity thereto. Such insulation is, however, not completely effective in preventing stray electric current from flowing from the cell through the electrolyte and to metal bodies, such as the iron pipe. Stray electric current from the cell hastens the corrosion, or rusting of, for example, iron in the metal pipe.

An electrode is inserted through a wall portion of the nonmetallic pipe, at a location spaced apart from the metal pipe, and attached to such pipe by well-known means, such as bolting. At least a portion of the electrode is in physical contact with the sodium chloride solution passing through the pipe. When the electrode is electrically connected to an electrical ground, a portion of the stray current flowing from the cell through the sodium chloride solution will pass through the electrode and to the ground. However, the iron pipe will still corrode, since the remaining portion of the stray current will continue flowing through the nonmetallic pipe and will enter the iron pipe.

When the electrolyte is a solution of sodium chloride and water, the reaction occurring at the electrode positioned in the nonmetallic pipe, when an electric potential is applied thereto, is:

$$2Cl^- = Cl_2(gas) + 2 \text{ electrons } (e)$$

The electrochemical reaction potential for this reaction at 25° C is about (−) 1.3 volts (V). An electrochemical reaction potential of about 0.4 V results when the reaction at the metal pipe is:

$$Fe \rightarrow Fe^{++} + 2e$$

To remove substantially all of the stray electric current from the nonmetallic pipe before such current reaches an iron pipe in physical contact with an aqueous sodium chloride solution, a direct current "bias" of at least 1.7 V, i.e. the difference between 1.3 V and −0.4 V, is applied to the electrode. The use of such a bias minimizes and preferably substantially eliminates corrosion of the iron pipe caused by stray electrical current. A bias within the range of from about 0.9 V to about 2.0 V will reduce corrosion of the iron exposed to the sodium chloride solution.

The specific bias applied to the electrode depends upon the compositions of the electrolyte and the metal pipe and the reactions which occur at the electrode and metal pipe. For example, following are representative of anode reactions occurring when various salts are dissolved in the electrolyte.

| Salt | Reaction | Approximate Potential at 25° C (volts) |
|---|---|---|
| $Na_2SO_4$ | $2H_2O \rightarrow O_2 + 4H^+ + 4e$ | −0.8 |
| $Na_2Br$ | $2Br^- \rightarrow Br_2 + 2e$ | −1.1 |
| NaI | $2I^- \rightarrow I_2 + 2e$ | −0.5 |

An electric bias about equal to the difference between the potentials of the reactions occurring at the electrode and at the metal pipe is preferred.

Electrodes suitable for use in the present invention include, for example, graphite, titanium and platinum. Titanium electrodes can be coated with an electrode activating layer of ruthenium and titanium oxide or cobalt oxide.

The following examples will further illustrate the invention.

EXAMPLE 1

An aqueous sodium chloride solution containing a minor amount of impurities was passed to an electrolytic cell through a corrodable iron alloy pipe and thereafter through a substantially nonconductive, corrosion resistant organic plastic pipe. Electric current leakage of 0.57 amperes from the cell through the solution in the pipe caused undesirable corrosion of the iron pipe. A corrosion resistant metal electrode with a greater oxidation potential than iron was inserted into the plastic pipe at a position spaced apart from both the iron pipe and the electrolytic cell. This electrode was suitably electrically attached to an electrical ground. A potential difference of −4.4 volts between the electrode and the ground was measured with a voltmeter.

Attachment of the grounded electrode to the plastic pipe resulted in removal of about 0.4 amperes of current, but did not eliminate corrosion of the iron pipe. At the approximate temperature at which the solution flows through the pipes (about 25° C), the electrochemical reaction potentials occurring at the electrode and iron pipe are about (−) 1.3 volts and 0.4 volts, respectively. When a potential of 1.7 volts was impressed between the electrode and the ground by means of a rectifier about 0.57 amperes, or substantially all, of the current leakage from the electrolytic cell was removed from the system. Corrosion of the iron pipe was minimized when such impressed potential was applied to the system.

EXAMPLE 2

Substantially as in Example 1, a potential of 2.0 volts was impressed between the electrode and the ground. About 0.58 amperes was removed from the system to satisfactorily reduce and minimize corrosion of the iron pipe.

EXAMPLE 3

Substantially as in Example 1, a potential of 1.5 volts was impressed between the electrode and the ground. About 0.54 amperes of the current leakage from the electrolytic cell was removed from the system. Corrosion of the metal pipe, through which the aqueous solution was passing, was reduced.

What is claimed is:

1. A method to reduce corrosion of a grounded metal conduit in an aqueous electrolyte conduit system including a nonmetallic conduit system physically attached to the metal conduit comprising impressing an electric potential between an anode positioned at least partially within the nonmetallic conduit and a ground, the potential being at least about the difference between the electrochemical reaction potentials, at the reaction temperature, of reactions occurring at the anode and at the metal conduit.

2. The method of claim 1 wherein the impressed potential is sufficient to minimize corrosion of an iron or iron alloy conduit when the electrolyte consists essentially of an aqueous sodium chloride solution.

3. The method of claim 1 wherein the impressed potential is from about 1.5 to about 2.0 volts.

4. A system to reduce corrosion of a grounded metal conduit with an inner surface in contact with an electrolyte comprising:

(a) a source of stray electric current, said source adapted to be in contact with the electrolyte;

(b) a conduit, having at least a nonmetallic inner surface, physically attached to said stray conduit source adapted to carry the electrolyte from said stray current source to a metal conduit;

(c) a grounded metal conduit, physically attached to said nonmetallic conduit, adapted to carry the electrolyte from said nonmetal conduit;

(d) an anode spaced apart from said metal conduit and physically attached to said nonmetallic conduit, said anode adapted to be in electric contact with the electrolyte within said nonmetallic conduit;

(e) a means to impress a predetermined electric potential between said electrode and a ground, the potential being at least equal to about the difference between the electrochemical reaction potentials, at the reaction temperature, of reactions occurring at said anode and said metal conduit.

5. The system of claim 4 wherein the metal conduit is an iron or iron alloy member and the nonmetallic conduit is an electric insulator.

* * * * *